US006118330A

United States Patent [19]

Bossard

[11] Patent Number: 6,118,330

[45] Date of Patent: Sep. 12, 2000

[54] LOOPED CIRCUIT AND ASSOCIATED METHOD FOR CONTROLLING THE RELATIONSHIP BETWEEN CURRENT AND CAPACITANCE IN CMOS AND BICMOS CIRCUIT DESIGN

[76] Inventor: Peter R. Bossard, 33 Oswin Turn, Langhorne, Pa. 19047

[21] Appl. No.: 09/252,641

[22] Filed: Feb. 19, 1999

[51] Int. Cl.[7] ..... G05F 3/02

[52] U.S. Cl. ..... 327/540; 327/541; 327/512; 327/378

[58] Field of Search ..... 327/540, 541, 327/542, 543, 512, 513, 378, 92, 94; 323/310, 313

[56] References Cited

U.S. PATENT DOCUMENTS

| | | | |
|---|---|---|---|
| 4,885,545 | 12/1989 | Sanielevici | 327/92 |
| 5,572,161 | 11/1996 | Myers | 327/538 |
| 5,949,274 | 9/1999 | Stanchak | 327/540 |

*Primary Examiner*—Timothy P. Callahan
*Assistant Examiner*—An T. Luu
*Attorney, Agent, or Firm*—LaMorte & Associates P.C.

[57] ABSTRACT

A looped circuit for generating a variable bias voltage. The looped circuit includes a variable current source having a current output that is dependent upon the variable bias voltage. The looped circuit also includes a capacitor that is periodically coupled to the current source for a predetermined period of time, wherein the current source charges the capacitor during each predetermined period of time. At least one subcircuit is provided for varying the variable bias voltage, wherein the variable bias voltage automatically causes the current source to charge the capacitor to a predetermined reference voltage during each predetermined period of time. Accordingly, the generated bias voltage will vary with temperature and other external variables. However, the ratio of the current produced by the current source divided by the capacitance of the capacitor is equal to the ratio of the predetermined reference voltage divided by the referenced predetermined period of time. This ratio remains constant regardless of variations in process and temperature.

16 Claims, 1 Drawing Sheet

LOOPED CIRCUIT AND ASSOCIATED METHOD FOR CONTROLLING THE RELATIONSHIP BETWEEN CURRENT AND CAPACITANCE IN CMOS AND BICMOS CIRCUIT DESIGN

REFERENCE TO DOCUMENT DISCLOSURE

The matter of this application corresponds to the matter contained in Disclosure Document 446,342 filed Oct. 26, 1998, wherein this application assumes the priority date of that document.

BACKGROUND OF THE INVENTION

1. Field of the Invention

The present invention relates the circuit design of CMOS and biCMOS circuits that contain resistors and capacitors that are actively laser trimmed. More particularly, the present invention is related to a method of manufacturing accurate CMOS and biCMOS circuits where the ratio of current over capacitance is kept constant, thereby reducing the need for active trimming procedures.

2. Description of the Prior Art

In the prior art record there are many circuits that are manufactured using CMOS and biCMOS manufacturing techniques. The use of CMOS and biCMOS in the manufacture of circuits has many known advantages. However, among the disadvantages of such manufacturing techniques is the inconsistency in performance of components made using the CMOS and biCMOS technologies. Performance inconsistencies of CMOS and biCMOS components are created by many different factors. Those factors include variations in the composition of CMOS and biCMOS materials from batch to batch. Variations are also caused by changes in the manufacturing process and changes in temperature as the components are used. The variations across process and temperature typically result in a ±50% uncertainty in the value of resistors made with CMOS and biCMOS technologies and a ±25% uncertainty in the value of capacitors.

In many circuits, the uncertainty values of CMOS and biCMOS resistors and capacitors are unacceptable. Accordingly, the resistors and capacitors are not manufactured to the exact values that are needed. Rather, the resistors and capacitors are then actively trimmed until the values of resistance and capacitance reach a desired value. CMOS and biCMOS resistors and capacitors are commonly laser trimmed. Such a procedure is expensive and time consuming. Furthermore, even after the resistors and capacitors are trimmed, only variations in process and materials have been removed. The values of resistance and capacitance still vary widely with changes in temperature. It is therefore common for trimmed CMOS and biCMOS circuits to contain precision external components in order to obtain exacting levels of performance.

A need therefore exists for a method of manufacturing certain CMOS and biCMOS circuits in a manner that does not require active trimming or the use of precision external components, yet enables the circuit to operate within exacting performance parameters. This need is met by the present invention as described and claimed below.

SUMMARY OF THE INVENTION

The present invention is a looped circuit for generating a variable bias voltage. The looped circuit includes a variable current source having a current output that is dependent upon the variable bias voltage. The looped circuit also includes a capacitor that is periodically coupled to the current source for a predetermined period of time, wherein the current source charges the capacitor during each predetermined period of time. At least one subcircuit is provided for varying the variable bias voltage, wherein the variable bias voltage automatically causes the current source to charge the capacitor to a predetermined reference voltage during each predetermined period of time. Accordingly, the generated bias voltage will vary with temperature and other external variables. However, the ratio of the current produced by the current source divided by the capacitance of the capacitor is equal to the ratio of the predetermined reference voltage divided by the referenced predetermined period of time. This ratio remains constant regardless of variations in process and temperature.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
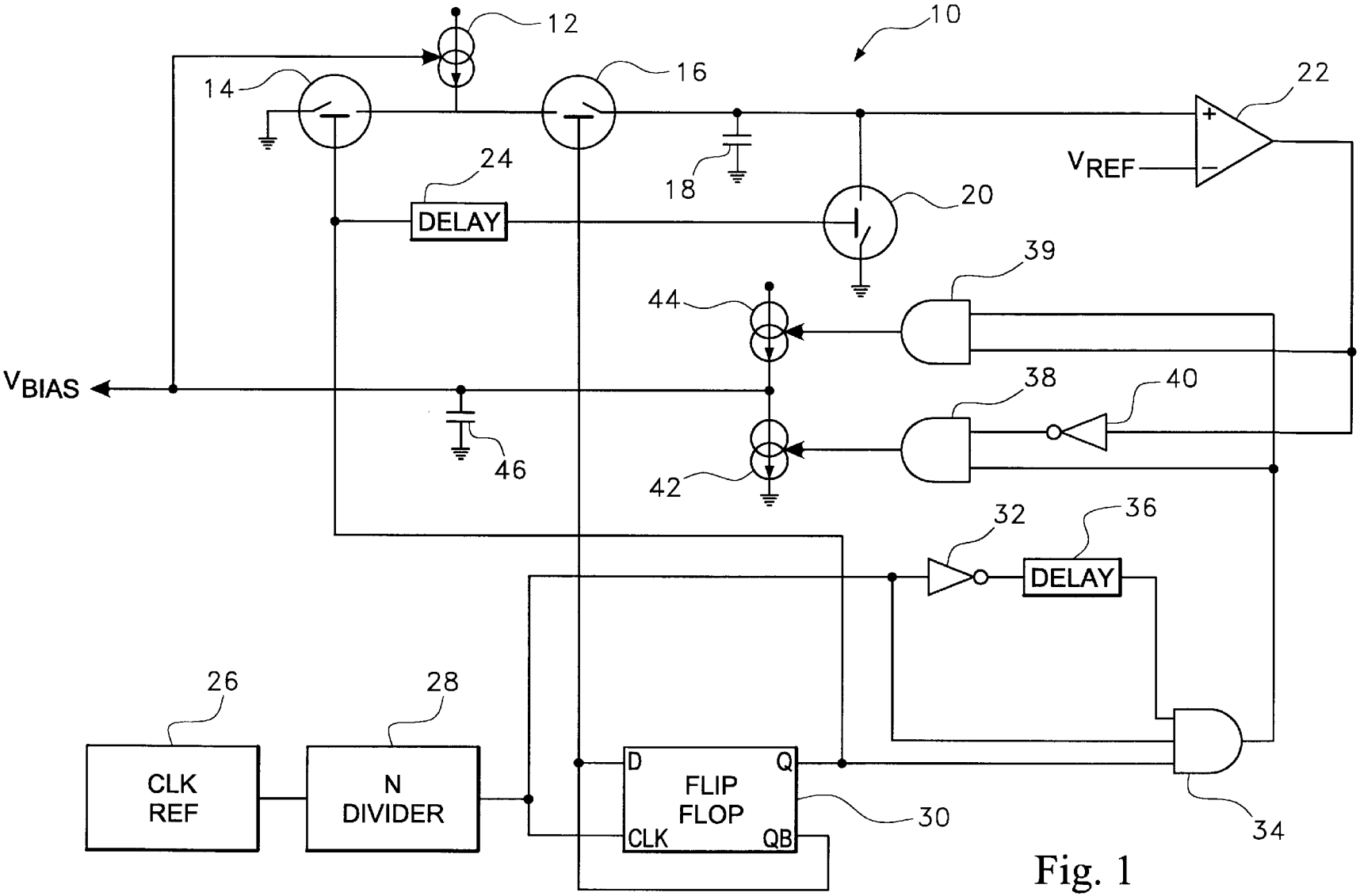
FIG. 1 is a schematic of an exemplary embodiment of an I/C loop circuit in accordance with the present invention.

The are many circuits that can be manufactured using CMOS and biCMOS manufacturing techniques where laser trimming is required to regulate the flow of current (I), via resistors, and capacitance (C), via the formation of capacitors. The present invention sets forth a method of manufacturing such circuits by holding the ratio of current over capacitance (I/C) constant. By holding I/C constant, a large amount of laser trimming can be eliminated, thereby significantly reducing the cost of manufacturing the circuit. Although the present invention method of manufacture can be adapted to different circuit designs, it is particularly well suited for use in the manufacture of charge pumps of the type utilized in many different phase locked loops.

Below is described an I/C loop circuit in accordance with the present invention. The description is divided into two sections. The first section of the description sets forth the physical structure of the I/C loop circuit shown in FIG. 1. Accordingly, the first section of the description concerns itself with the physical components of the I/C loop circuit and how those components interconnect. The second section of the description describes the operation of the circuit and illustrates the principles upon which the circuit operates.

Description of Circuit

Referring to FIG. 1, there is shown an exemplary schematic of an I/C loop circuit 10 in accordance with the present invention. The I/C loop, 10 as will be explained, produces a bias voltage (Vbias). The bias voltage (Vbias) is looped back to a current source 12. The current source 12 produces an output current that is monotonically dependent on the input bias voltage (Vbias). The output current of the current source 12 leads to two transistors 14, 16. The first transistor 14 is preferably an N channel CMOS transistor. The drain of the first transistor 14 leads to both the second transistor 16 and the current source 12. The source of the first transistor 14 is connected to ground. Accordingly, when the first transistor 14 is closed, the current source 12 is directly coupled to ground.

The second transistor 16 is an analog CMOS transistor which has its drain connected to both the current source 12 and the drain of the first transistor 14. The second transistor 16 is turned on by driving its gate voltage high. The second transistor 16 controls the interconnection between the current source 12 and a first capacitor 18. The first capacitor 18 plays a significant role in the operation of the I/C loop circuit 10, as will be later explained.

The first capacitor 18 is also coupled to a third transistor 20. The third transistor 20 is preferably an N channel CMOS transistor having a source connected to ground. When the gate of the third transistor 20 is driven high, the first capacitor 18 is discharged to ground. The third transistor 20 is therefore responsible for discharging any electrical charge that may accumulate on the first capacitor 18 while the gate of the first transistor 14 is held at zero voltage, with respect to its drain, and the current source 12 is charging the first capacitor 18 to some voltage level.

A two-input/single-output comparator 22 is provided. One input of the comparator 22 is coupled to a predetermined reference voltage (Vref). The second input of the comparator 22 leads to both the first capacitor 18 and the source of the second transistor 16.

The gates of the first and third transistors 14, 20 are coupled to a delay circuit 24. The delay circuit 24 produces a time delay sufficient to enable the comparator 22 to respond to the voltage on the first comparator 18. The switching of the first and second transistors 14, 16, and the time periods that these transistors remain open and closed will be later described.

A clock reference 26 is provided to create an input reference frequency. The input reference frequency is divided by an integer (N). The division is performed by a divided divider 28 that is connected to the clock reference 26. A D-type flip flop 30 is then used to further divide the divided input reference frequency by two. The D-type flip flop 30 has a "D" input, a clock input, a "Q" output and a "QB" output, where the "Q" output and the "QB" output are 180° out of phase. The ½ division is accomplished by looping the bar "QB" output of the flip flop 30 back into the "D" input of the flip flop 30.

The "QB" output of the flip flop 30 is coupled to the gate of the second transistor 16. Accordingly, the value of the "QB" output regulates the opening and closing of the second transistor 16 and the period of time that the first capacitor 18 is connected to the current source 12. Similarly, the "Q" output of the flip flop 30 is coupled to the gate of the first transistor 14. Accordingly, the value of the "Q" output regulates the opening and closing of the first transistor 14 and the period of time that the first transistor 14 connects the current source 12 to ground. The "Q" output of the flip flop 30 also passes through the delay circuit 24 and leads to the gate of the third transistor 20. The delayed "Q" output therefore regulates the opening and closing of the third transistor 20.

Since the "Q" output of the flip flop 30 is delayed on its way to the gate of the third transistor 20, the opening and closing of the first transistor 14 and the third transistor 20 will not be synchronous. Rather, when the first transistor 14 closes, the second transistor 16 opens and the current source 12 is grounded. After the time delay introduced by the delay circuit 24, the third transistor 20 closes and drains any charge present in the first capacitor 18. The first capacitor 18 then stands ready to be recharged when the first and third transistors 14, 20 open and the second transistor 16 closes.

The bias voltage (Vbias) used by the current source 12 is also partially dependent upon the "Q" output of the flip flop 30. As the input reference frequency leaves the divider 28, the divided reference frequency leads into both an invertor 32 and a three-input AND gate 34. The output of the invertor 32 is delayed by a second delay circuit 36. The second delay circuit 36 delays the inverted signal for only a short period of time that is shorter than the delay provided by delay 24.

The delayed signal, the divided input reference frequency and the "Q" output of the flip flop 30 are all inputs to the three-input AND gate 34. The AND gate 34 only allows a high output signal when all three of the inputs are high. Because two of the inputs are from the same source, except that one is inverted and delayed, the AND gate 34 only allows a high output for the period of delay used in the second delay circuit 36.

The output of the three-input AND gate 34 is fed to two separate two-input AND gates 38, 39. The first two-input AND gate 38 receives the inverted output of the comparator 22, as well as the feed from the three-input AND gate 34. The output of the comparator 22 is inverted by a high/low invertor 40. The second two-input AND gate 39 receives the direct output from the comparator 22 as well as the feed from the three-input AND gate 34. Both two-input AND gates 38, 39 only allow for a high output signal when both input signals are high.

The output of each two-input AND gate 38, 39 is directed to a separate constant current source 42, 44. Each constant current source 42, 44 is preferably of the type that can be turned on or off in a 10 ns or less time frame. The output of both constant current sources 42, 44 is combined and is fed to a second capacitor 46. The second capacitor 46 can be a gate capacitor, if desired. The purpose of the second capacitor 46 is to integrate the current outputs from both the constant current sources 42, 44 so that the bias voltage (Vbias) is held to the value of the voltage bias needed so that the current source 12 charges the first capacitor 18 to the reference voltage in the period of time (N/frequency) produced by the divider 28.

The period of delay produced by delay circuit 36 is always less than the period of delay produced by delay circuit 24. Accordingly, the state of the comparator 22 only effects the charging or discharging of the second capacitor 46, when the first capacitor 18 is at its maximum voltage. The maximum voltage is on the first capacitor 18 for a time determined by delay circuit 24. The period of delay produced by delay circuit 24 determines the time between the turning off of the first transistor 16 and the turning on of the second transistor 20. After the first transistor turns off the first capacitor 18, the first capacitor 18 is at its maximum voltage. This voltage is held on the first capacitor 18 until the second transistor 20 is turned on and starts to discharge the first capacitor. The second capacitor 46 is charged or discharged for an amount of time determined by delay circuit 36. The period of delay produced by the delay circuit 36 is typically less than half of the period of delay produced by delay circuit 24. As such, the period of delay produced by delay circuit 36 starts and finishes within the period of time when the first capacitor is at its maximum voltage.

Setting the period of delay produced by delay circuit 36 to a short period of time (e.g. 10 ns) prevents the second capacitor 46 from making a large voltage change during any one charging cycle. After the correct bias voltage is reached on the second capacitor 46, the voltage variation of voltage is reached on the second capacitor 46, the voltage variation of voltage bias Vbias is very small. The second transistor 20 is sized so that the first capacitor 18 is completely discharged before the next charging cycle starts.

Operation of I/C Loop Circuit

With the physical structure of the exemplary I/C loop circuit 10 having been described, it can be seen that current source 12 is controlled by the bias voltage (Vbais) produced by the I/C loop circuit 10. The current source 12 can be considered as having a negative current coefficient if the current output from the current source decreases as bias voltage (Vbias) increases. In the example of the I/C loop circuit 10 shown in FIG. 1, the current source 12 should be considered as having a negative current coefficient.

The ratio of the output current (I) from the current source 12 to the capacitance (C) of the first capacitor 18 is the ratio that is set equal to a desired value and then held constant across variations in process parameters and temperature. The ratio is expressed by rearranging the classical equation (shown below) for the current flowing into a capacitor as a function of the voltage rate of change across the capacitor. The referenced equation is:

$$I=C\cdot(dV/dt)$$

Solving for the ratio of I/C, it can be seen that:

$$I/C=dV/dt$$

It is the ratio of (dV/dt) that the present invention I/C loop circuit 10 is able to hold constant across process and temperature. Accordingly, since (dV/dt) is equivalent to I/C, I/C is also held to a constant across variations in process and temperature.

In the above equations, it will be understood that the value of time (dt) in the I/C loop circuit 10 is provided by the Clock reference 26 and divider 28, wherein:

$$dt=N/\text{Clock Reference}$$

The Clock reference 26 is the input to the divider 28 shown in FIG. 1, wherein the divider 28 divides the Clock reference by an integer (N).

The value of (dV) in the above cited equations is the value of the reference voltage (Vref), which is supplied to the comparator 22 in FIG. 1. Stated mathematically:

$$dV=Vref$$

The value of the reference voltage (Vref) is typically supplied from a band gap source.

The I/C loop circuit 10 of FIG. 1 starts by switching the current source 12 from ground to the first capacitor 18. This is accomplished by opening the first transistor 14 and closing the second transistor 16. The first capacitor 18 is initially at ground, prior to when the current source 12 starts to charge the capacitor 18. The draining of the first capacitor 18 to ground prior to charging is performed by the closing and then opening of the third transistor 20. The first capacitor 18 is allowed to charge for exactly time (dt). As has been previously shown (dt) is equal to N÷Clock reference.

After the first capacitor 18 has been charged for the time (dt) at current (I), the voltage of the first capacitor 18 will be equal to the reference voltage (Vref). If the voltage on the first capacitor 18 is generally equal to the reference voltage (Vref), then I/C loop circuit 10 will push the bias voltage (Vbias) up and down by a predetermined amount. The variations in the bias voltage (Vbias) will be centered on the correct bias voltage required by the current source 12.

However, if the voltage on the first capacitor 18 does not reach the reference voltage (Vref) in the allotted time (dt), then the current (I) being generated by the current source 12 is too small. To compensate for the inadequate current, the I/C loop circuit 10 removes some charge from the second capacitor 46. This lowers the bias voltage (Vbias) and therefore increases the current generated by the current source 12. The bias voltage (Vbias) is continually increased until the voltage level reached by the first capacitor 18 during the time period (dt) is greater than the reference voltage (Vref). At this point, the current being provided by the current source 12 is too great. To decrease the current output of the current source 12, the I/C loop circuit 10 adds a charge to the second capacitor 46. This raises the voltage bias (Vbias) and subsequently lowers the current output of the current source 12.

Using the above technique to selectively control the voltage bias (Vbias), the voltage bias (Vbias) can be supplied to other devices that are scaled mirrors of the current source. When these current sources are used in conjunction with the same type of capacitor as the first capacitor, but scaled to the capacitor value needed, then the resulting ratio of I/C will be known and will be held constant across process and temperature. Generating a precise fixed pulse width dt using Vbias can be done by using:

$$dt=(Is/Cs)*dV$$

where Is is a scaled version of the current source 12 and Cs is a scaled version of the first capacitor 18. dV is the voltage needed at negative input of comparator 22 to obtain the desired pulse width when using Is and Cs. This voltage. dV, is generally generated from a band-gap reference. Because the ratio Is and Cs is held constant across process and temperature the pulse width dt is also held constant across process and temperature.

It will be understood that the specifics of the I/C loop circuit described above illustrates only one exemplary embodiment of the present invention. A person skilled in the art can therefore make numerous alterations and modifications to the shown embodiment utilizing functionally equivalent components and circuit layouts to those shown and described. All such modifications are intended to be included within the scope of the present invention as defined by the appended claims.

What is claimed is:

1. A looped circuit for generating a variable bias voltage, comprising:

a variable current source controlled by the variable bias voltage, wherein said current source produces an output current that is dependent upon the variable bias voltage;

a capacitor periodically coupled to said current source for a predetermined period of time, wherein said current source charges said capacitor during each said predetermined period of time; and at least one subcircuit for varying the variable bias voltage, wherein the variable bias voltage automatically causes said current source to charge said capacitor to a predetermined reference voltage during each said predetermined period of time;

wherein a ratio of the current produced by said current source divided by the capacitance of said capacitor is equal to the ratio of said predetermined reference voltage divided by one said predetermined period of time.

2. The circuit according to claim 1, wherein said current source is of the type that deceases its output current when the bias voltage increases and increases its output current when the bias voltage decreases.

3. The circuit according to claim 1, wherein said current source has an output current that is monotonically dependent upon the bias voltage.

4. The circuit according to claim 1, further including a means for dissipating any charge on said capacitor during periods of time when said current source is not coupled to said capacitor.

5. The circuit according to claim 1, wherein said current source is coupled to said capacitor via at least one transistor.

6. The circuit according to claim 1, wherein said current source is coupled to ground when not charging said capacitor.

7. The circuit according to claim 5, wherein said subcircuit includes:

a clock reference that provides a predetermined reference frequency;

a divider coupled to said clock that divides said predetermined reference frequency; and a flip flop coupled to said divider, wherein said flip flop controls the operation of said at least one transistor.

8. The circuit according to claim 7, wherein said subcircuit further includes:

a second current source;

a third current source, wherein outputs from said second current source and said third current jointly generate the bias voltage; and a second capacitor coupled to said third current source, wherein said second capacitor is capable of increasing and decreasing the bias voltage throughout a range of voltages.

9. In a circuit having a current source that supplies a current and a capacitor that supplies a capacitance, wherein said capacitance varies with temperature, a method of forming the circuit so that the ratio of the current divided by the capacitance is held at a fixed value regardless of changes in temperature, said method comprising the steps of:

periodically charging said capacitor with said current source for a predetermined period of time so that said capacitor achieves a charge voltage;

comparing said charge voltage to a predetermined reference voltage; and adjusting current produced by said current source so that said charge voltage approaches said reference voltage;

wherein a ratio of the current produced by said current source divided by the capacitance of said capacitor is equal to the ratio of said predetermined reference voltage divided by said predetermined period of time.

10. The method according to claim 9, wherein said step of adjusting current produced by said current source includes the substeps of:

increasing the current produced by said current source if said charge voltage is less that said reference voltage; and decreasing the current produced by said current source if said charge voltage is greater than said reference voltage.

11. The method according to claim 9, further including the step of dissipating charge from said capacitor after each said period of time.

12. The method according to claim 9, further including the step of generating a fixed width pulse with said charge voltage, wherein said pulse has a width that is independent of changes in temperature.

13. A method of forming a circuit, comprising the steps of:

providing a first current source that produces an output current dependent upon an input control voltage;

periodically charging a capacitor with said first current source for a predetermined period of time, wherein said first current source charges said capacitor each time to a charge voltage;

comparing said charge voltage to a reference voltage during each said predetermined period of time;

charging the input control voltage to said first current source so that said current source charges said capacitor to a charge voltage that approaches said reference voltage;

wherein a ratio of the current produced by said current source divided by the capacitance of said capacitor is equal to the ratio of said predetermined reference voltage divided by said predetermined period of time.

14. The method according to claim 13, wherein said step of changing the input control voltage of said first current source includes the substeps of:

decreasing the control voltage if said charge voltage is greater that said reference voltage; and increasing the current produced by said current source if said charge voltage is less than said reference voltage.

15. The method according to claim 13, further including the step of dissipating charge from said capacitor after each said predetermined period of time.

16. The method according to claim 13, further including the step of generating a fixed width pulse with said input control voltage, wherein said pulse has a width that is independent of changes in temperature.

* * * * *